US010660383B2

(12) United States Patent
Carraro

(10) Patent No.: US 10,660,383 B2
(45) Date of Patent: May 26, 2020

(54) HEADGEAR FOR A SHIELDING GARMENT WITH FACE SHIELD

(71) Applicant: Carraro S.r.l., Paruzzaro NO (IT)

(72) Inventor: Rinaldo Carraro, Paruzzaro (IT)

(73) Assignee: Carraro S.r.l. (IT)

( * ) Notice: Subject to any disclaimer, the term of this patent is extended or adjusted under 35 U.S.C. 154(b) by 182 days.

(21) Appl. No.: 15/671,764

(22) Filed: Aug. 8, 2017

(65) Prior Publication Data

US 2018/0042311 A1 Feb. 15, 2018

(30) Foreign Application Priority Data

Aug. 10, 2016 (IT) ..... 102016000084391

(51) Int. Cl.

| | |
|---|---|
| ***A41D 13/008*** | (2006.01) |
| ***A42B 1/04*** | (2006.01) |
| ***A41D 31/08*** | (2019.01) |
| ***A41D 13/11*** | (2006.01) |
| ***A41D 1/00*** | (2018.01) |

(52) U.S. Cl.

CPC ..... *A41D 13/008* (2013.01); *A41D 1/002* (2013.01); *A41D 13/1153* (2013.01); *A41D 13/1184* (2013.01); *A41D 31/08* (2019.02); *A42B 1/048* (2013.01); *A41D 2200/20* (2013.01); *A41D 2300/324* (2013.01)

(58) Field of Classification Search

CPC ..... A41D 13/04; A41D 13/008; A41D 13/26; A41D 2200/20; A62B 18/02; A62B 18/10

USPC ..... 2/9, 202, 206, 424; 428/357, 361, 373, 428/375, 381; 442/132, 133

See application file for complete search history.

(56) References Cited

U.S. PATENT DOCUMENTS 3,164,840 A 1/1965 Reynolds
3,310,709 A * 3/1967 Phillips ..... A61F 9/02 2/9

(Continued)

FOREIGN PATENT DOCUMENTS

| | | |
|---|---|---|
| CN | 201156991 Y | 12/2008 |
| WO | 2008114294 A1 | 9/2008 |
| WO | 2008114296 A1 | 9/2008 |

OTHER PUBLICATIONS

Italian Search Report dated Mar. 30, 2017 for IT 20160008439.

*Primary Examiner* — Katherine M Moran

(74) *Attorney, Agent, or Firm* — Alan G. Towner; Leech Tishman Fuscaldo & Lampl

(57) ABSTRACT

Headgear for a shielding garment for operating on components exposed to high voltage, or for operating at a safe distance proximate to high voltage parts, or for activities involving exposure to high electric and/or electromagnetic fields at any frequency and voltage is disclosed. The headgear comprises a cover element which is configured to cover the head of an operator and has an opening at least at an upper portion of the operator's face. The headgear further comprises a transparent face shield made of an electrically conductive fabric. The face shield is removably coupled to the cover element to close the opening and is electrically connected to the shielding garment. The fabric has a density ranging from 25 to 40 g/m$^2$ and comprises a plurality of yarns having a yarn count ranging from 10 to 30 deniers, and each comprising a respective core externally covered with a coating made of a conductive metal.

14 Claims, 6 Drawing Sheets

(56) References Cited

U.S. PATENT DOCUMENTS

| | | | | |
|---|---|---|---|---|
| 3,359,567 | A | 12/1967 | Zemme et al. | |
| 5,968,854 | A | 10/1999 | Akopian et al. | |
| 8,074,300 | B1 * | 12/2011 | Molina | A42B 1/08 2/202 |
| 2004/0102116 | A1 * | 5/2004 | Caudell | D03D 15/0005 442/182 |
| 2014/0352043 | A1 * | 12/2014 | Harvey | A41D 13/001 2/456 |
| 2016/0295950 | A1 * | 10/2016 | Schurr | A42B 3/225 |

* cited by examiner

HEADGEAR FOR A SHIELDING GARMENT WITH FACE SHIELD

CROSS-REFERENCE TO RELATED APPLICATION

This application claims the benefit of Italian Patent Application No. 102016000084391 filed on Aug. 10, 2016, which is incorporated herein by reference.

FIELD OF INVENTION

The present invention relates to a headgear for a shielding garment for operating on components exposed to high voltage, or for operating at a safe distance proximate to high voltage parts, or for activities involving exposure to high electric and/or electromagnetic fields at any frequency and voltage.

Such headgear usefully finds application as a protective headgear for operators charged with the maintenance of components exposed to high voltage, e.g. high voltage conductors or components attached thereto (spacers, isolators) or for operating at a (safe) distance proximate to high voltage parts, or with intense electric and/or electromagnetic fields of any frequency and voltage.

When high voltage cables are deteriorated (e.g. untwisted) they must be serviced with live techniques to prevent them from breaking and causing serious damages to structures or shutdowns.

Operators must operate with live techniques and appropriate preparation steps to eliminate risks of discharge (or short-circuit) between two different high voltage phases or to the ground. Potential differences may be of the order of 1000 kV AC or 800 kV DC.

Obviously, garments should be provided that can provide shielding from the electric and/or electromagnetic field in the operating site, or in those situations in which a reduction of reflected electromagnetic waves is desired (radar image reduction).

BACKGROUND

Shielding garments are known in the art, which are made of stainless steel yarns twisted with cotton yarns. Nevertheless, these garments suffer from a number of drawbacks: their electrical resistance, as measured between any two points, is relatively high; when they are being tested, they must be "triggered" to electrical conduction by injection of a considerable electric current (to overcome the inherent semiconductive barriers of the material) to trigger their electrical conductivity; furthermore the rigidity of stainless steel yarns leads to rigid and uncomfortable garments, that may hinder the movements of the operators, which will further reduce the operating safety margins; finally, these garments exhibit an apparent degradation of their conductive properties after a common washing cycle.

In an attempt to obviate these drawbacks, and to ensure compliance with the International Standard IEC 60895, the Applicant designed an improved shielding garment. Such shielding garment is disclosed in the international patent application by the Applicant hereof, which was published with number WO 2008/114294 and issued in Europe and in other countries. Thus, shielding garment comprises a first electrically conductive layer whose surface area is substantially equal to the surface area of the garment. The first electrically conductive layer is a textile product obtained from a conductive yarn comprising a polymeric core covered with a silver layer. Such textile product is obtained with the space between two adjacent yarns defining an electrical continuity area. A second layer, obtained from a second yarn, has flame-retardant properties and is obtained from a polyaramid fiber. The first and second layers are both provided in knit form ad are stably coupled together over the entire mutual contact surfaces of the two layers. The garment further comprises a hood and/or a visor and/or one or more collars, to also cover, and hence shield the nape and part of the face of the operator. These elements are integrated together. It shall be noted that the visor is of rigid type.

SUMMARY OF THE INVENTION

The aforementioned product standard is currently being revised, with technical and safety requirements becoming more stringent. The garment is required to be able to shield the operator from electric fields generated by potential differences up to 1000 kV for alternating current or 800 kV for direct current. While the above described garment ensures a very good performance to 800 kV for alternating current and to 600 kV for direct current, it must be adapted to provide safety for the operator under the new voltage levels imposed by standard evolution. Particularly difficult conditions are found at the face of the operator.

Furthermore, in view of the increasing requirement of protecting workers by setting prudential limits of exposure to electric and electromagnetic fields (see for instance the European Directive 2013/35/UE and relevant standards and implementation decrees of the individual member states), protection must be ensured for workers in compliance with the new limits of exposure to electric and/or electromagnetic fields of any frequency and voltage.

Here, the technical purpose of the present invention is to provide a headgear for a shielding garment for operating on components exposed to high voltage, or for operating at a safe distance proximate to high voltage parts, or for activities involving exposure to high electric and/or electromagnetic fields at any frequency and voltage, that can meet both the evolved technical requirements of the reference technical standard, and the new requirements for limiting exposure to electric and/or electromagnetic fields.

Namely, the present invention has the object of providing a headgear for a shielding garment, that can noticeably improve the shielding protection for the operator at very high voltages.

A further object of the present invention is to protect operators from electric and/or electromagnetic fields of any frequency and voltage, when operating proximate to high voltage electrical installations or radio frequency-emitting antennas, such as mobile communication repeaters, radio-television transmitters, radars or else.

A further application of the inventive object is to considerably reduce reflected electromagnetic waves, i.e. to reduce the radar image.

The aforementioned technical purpose and objects are substantially fulfilled by a headgear for a shielding garment that comprises the technical features as disclosed in one or more of the accompanying claims.

Such headgear for a shielding garment solves the technical problem as it considerably improves the shielding capacity. Particularly, the face shield that closes the opening ensures shielding effectiveness even at the new voltage values (to 1000 kV for alternating current and 800 kV for direct current) as compared with the commonly used rigid visor. The headgear with the face shield further affords equivalent comfort as it allows optimal air passage, and prevents excessive sweating. This also avoids fogging and always keeps perfect visibility.

Thus, a continuous cover is formed, which creates a substantially perfect Faraday cage, allowing the headgear to meet the requirements imposed by the aforementioned standards concerning electric shielding properties. Such headgear with the face shield must be used to accommodate the new voltage levels that have been set by the current revision of the international standard IEC 60895, but may be also used at lower voltage levels, if a higher shielding protection is required for the operator.

The headgear for a shielding garment of the present invention may be used for operating at a (safe) distance proximate to high voltage parts, or for activities involving exposure to high electric fields at any frequency and voltage, but also for all activities involving exposure to high electromagnetic fields at any frequency and voltage. It may be also used to reduce reflected electromagnetic waves.

An aspect of the present invention is to provide headgear for a shielding garment for operating on components exposed to high voltage, or for operating at a safe distance proximate to high voltage parts, or for activities involving exposure to high electric and/or electromagnetic fields at frequencies and voltages, wherein the headgear comprises a cover element structured and arranged to cover the head of an operator comprising an opening at least at an upper portion of the operator's face, and a transparent face shield made of an electrically conductive fabric, the face shield being removably coupled to said cover element to close the opening and being electrically connected to the shielding garment, the fabric having a density ranging from 25 to 40 g/m2, and wherein the fabric comprises a plurality of yarns having a yarn count ranging from 10 to 30 deniers, and each of the plurality of yarns comprises a core externally covered with a coating made of a conductive metal.

Another aspect of the present invention is to provide a shielding garment for operating on components exposed to high voltage, or when operating at a safe distance proximate to high voltage parts, or for activities involving exposure to high electric and/or electromagnetic fields at frequencies and voltages, comprising headgear as described above.

These and other aspects of the present invention will be more apparent from the following description.

BRIEF DESCRIPTION OF THE DRAWINGS

Further features and advantages of the present invention will result more clearly from the illustrative, non-limiting description of a preferred, non-exclusive embodiment of a module for extractor hoods, as shown in the annexed drawings, in which.

DETAILED DESCRIPTION

Figure 1:
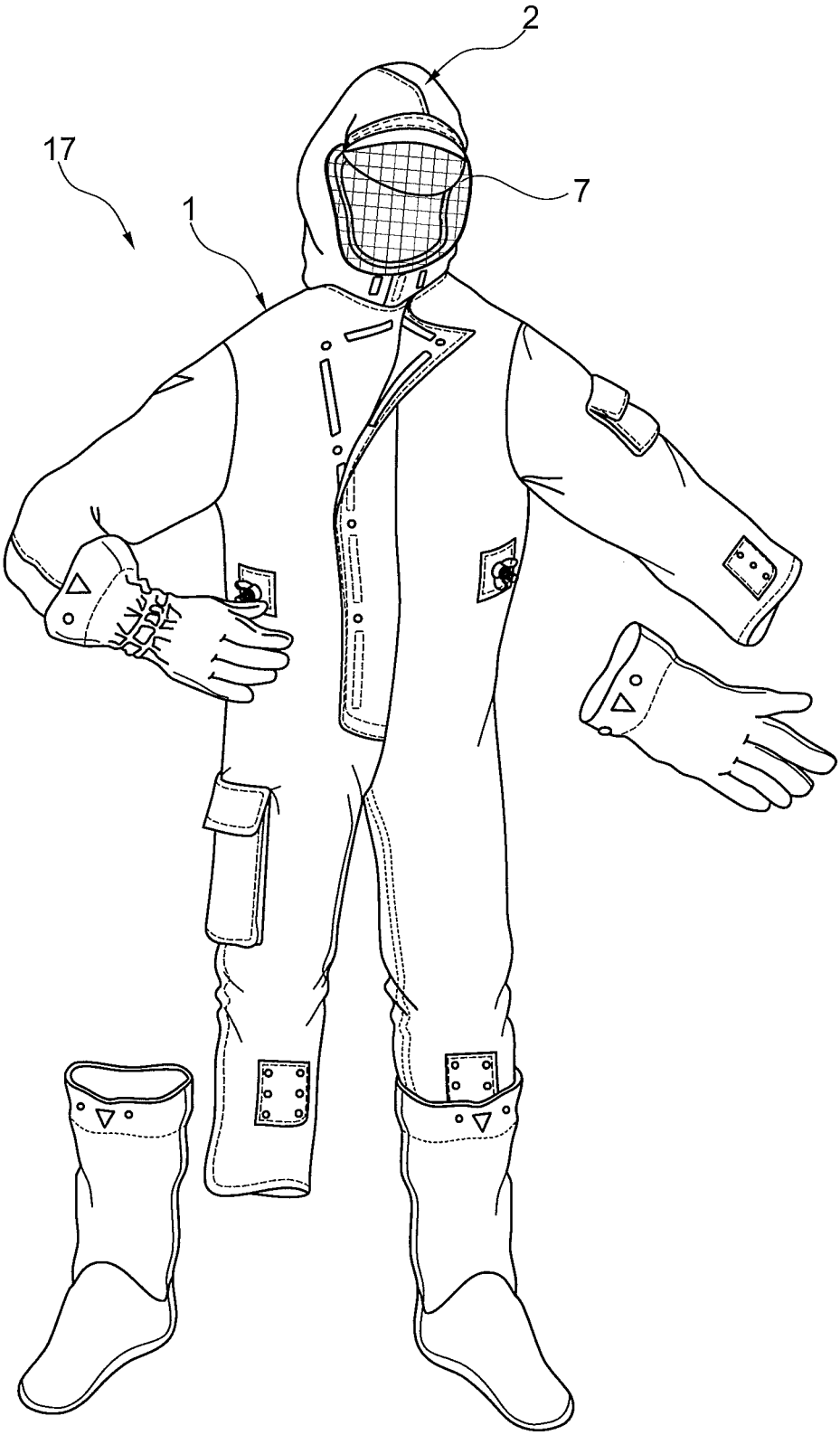
FIG. 1 is a front view of a shielding garment having a headgear of the present invention.

Referring to the accompanying figures, numeral 1 designates a headgear for a shielding garment 17 of the present invention, for operating on components exposed to high voltage, or for operating at a safe distance proximate to high voltage parts, or for activities involving exposure to high electric and/or electromagnetic fields at any frequency and voltage.

The shielding garment 17 may be a one-piece overall or a part, e.g., an upper half, thereof.

The headgear 1 comprises a cover element 2 which is configured to cover the head of an operator and has an opening 3 at least at an upper portion of the operator's face.

According to one embodiment, not shown, the cover element 2 is made of a rigid material, possibly an electrically conducting material, e.g. a safety helmet.

According to the embodiment in the figures, the cover element 2 comprises a hood made of an electrically conductive fabric 8, the fabric 8 comprising a plurality of yarns 4 obtained by twisting aramid fibers 5 with metallized fibers 6. In this embodiment, the hood 2 is electrically connected to the shielding garment 17.

Reference will be made hereinafter, for simplicity and without limitation, to the embodiment of the annexed figures in which the cover element 2 comprises the hood 2 made of the fabric 8.

Particularly, the hood 2 has an upper portion 2*a*, which is designed to cover the top of the head of an operator. The hood 2 further has two lateral portions 2*b*, which are designed to cover the sides of the head of an operator. The hood 2 further has a lower portion 2*c*, which is designed to cover the chin and neck of the operator.

It shall be noted that the portions 2*a*, 2*b*, 2*c* may be made from multiple pieces of fabric 8 and sewn together, or from a single piece. In any case the hood 2 may be sewn in any manner known by the skilled person, as long as a yarn made of fire-proof, electrically conductive fibers is used.

In operation, the opening 3 is located level with the face of an operator. Namely, the opening 3 has a perimeter 3*a*. The perimeter 3*a* is particularly defined on the lateral portions 2*b*, the upper portion 2*a* and the lower portion 2*c*. Particularly, the opening 3 is designed to allow the operator to look through it but, depending on the embodiments, it may also extend level with the nose and mouth of the operator. This will advantageously improve visibility, ventilation and comfort for the user.

The headgear 1 further comprises a visor 10 attached to the hood 2 and located above the opening 3 to enhance shielding from electric and/or electromagnetic fields and also shield the operator from sunlight. The visor 10 is preferably rigid. More in detail, the visor 10 is connected to the upper portion 2*a* of the hood 2.

The headgear 1 further comprises a collar 16 connected to the hood 2. Such collar 16 is particularly connected to the lateral portions 2*b* and covers the lower area of the opening 3. If not used, the collar 16 may be folded and fixed to the nape of the hood 2.

Figure 5:
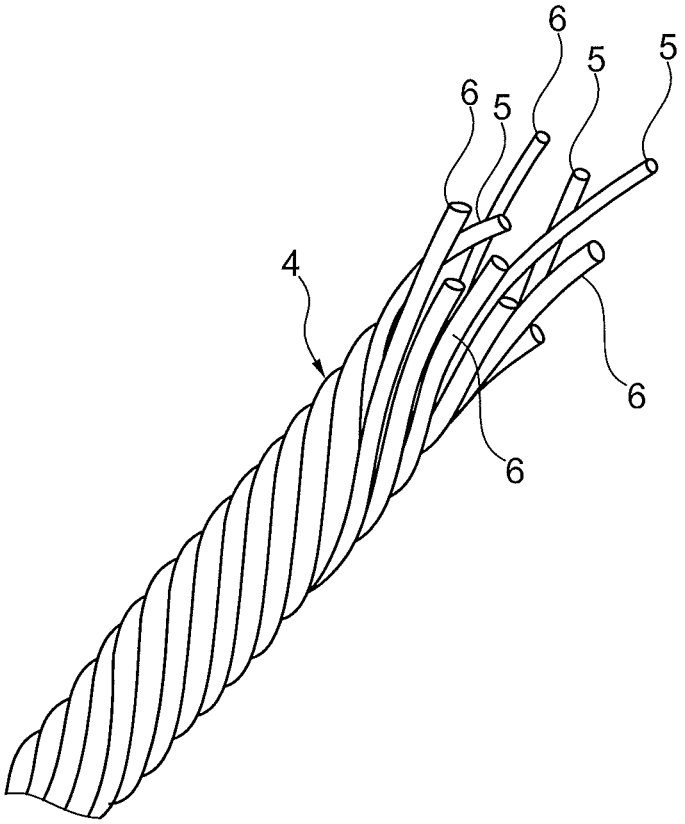
FIG. 5 is a perspective view of a yarn that is used to form a first part of the headgear and the shielding device of FIG. 1.

The fabric 8 particularly comprises a plurality of yarns 4 obtained by twisting aramid fibers 5 with metallized fibers 6, as shown, for instance, in FIG. 5. According to the preferred embodiment the yarn 4 is 35% metallized fiber 6 and 65% aramid fiber. For example, the aramid fibers 5 and the metallized fibers 6 may be as disclosed in WO 2008/114296.

In the present invention, the headgear 1 comprises a transparent face shield 7. Such face shield 7 is formed from an electrically conductive fabric 9. Furthermore, the face shield 7 is removably coupled to the hood 2 to close the opening 3 and is electrically connected to the shielding garment 17. Preferably, the face shield 7 is also electrically connected to the hood 2.

The face shield 7 allows the operator to see through it while ensuring proper breathability as well as an excellent electric conductivity and, as a result, an effective shielding effect.

Figure 2:
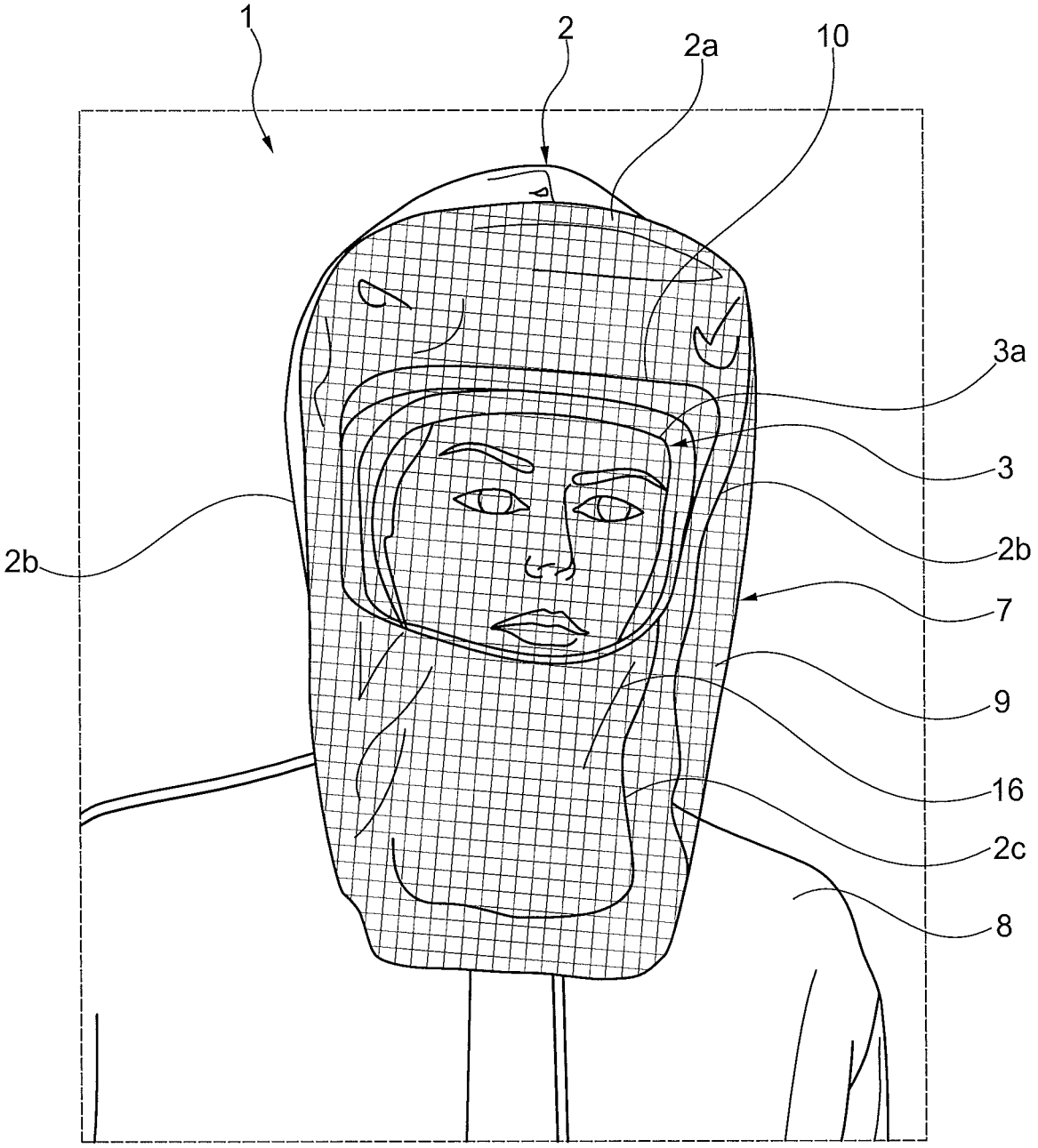
FIG. 2 is a front view of the headgear of FIG. 1.
Figure 3:
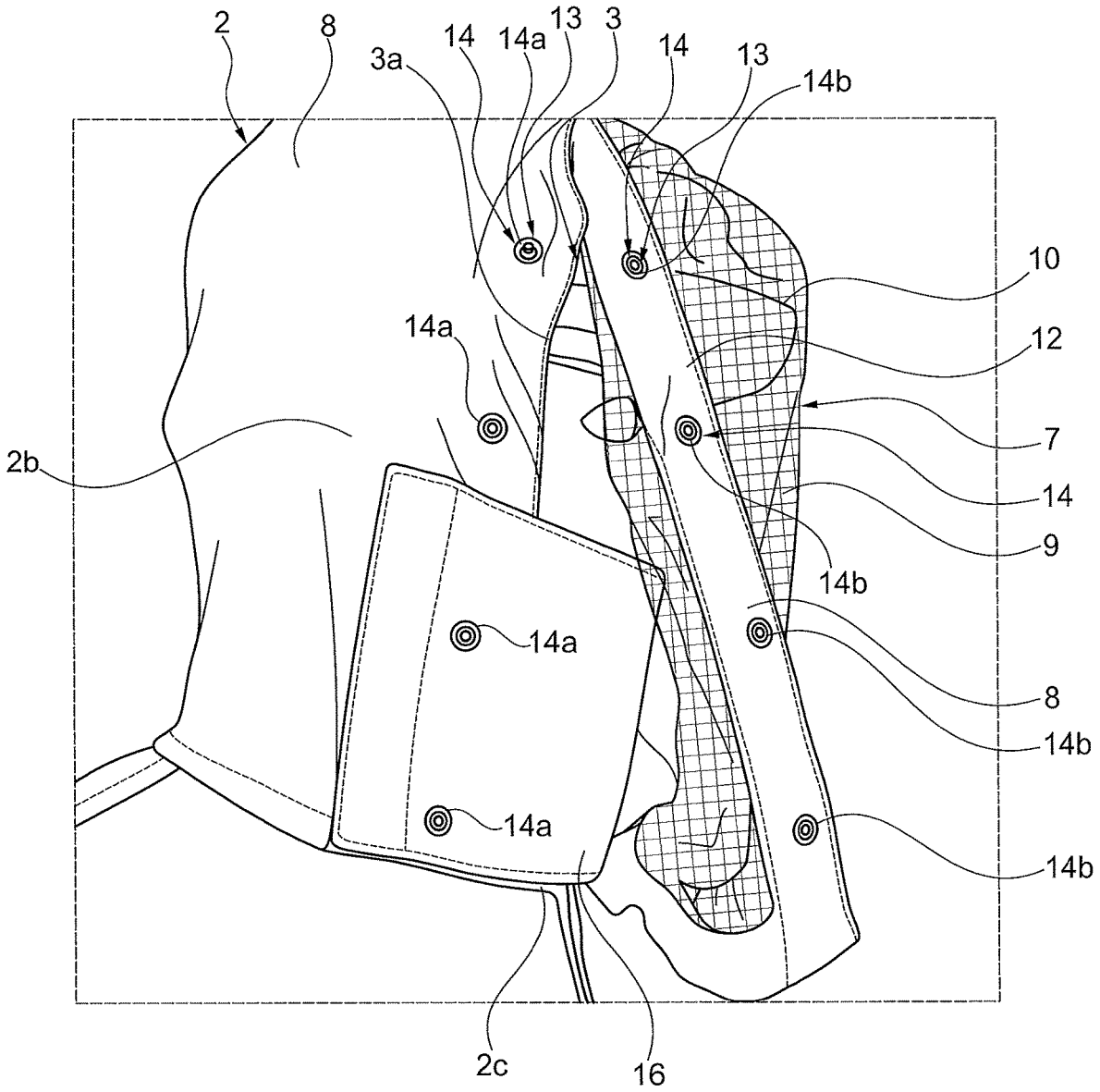
FIG. 3 is a side view of the headgear of FIG. 2.

As particularly shown in FIGS. 2 and 3, in operation the face shield 7 covers the visor 10. It shall be noted that, in order to improve adhesion to the visor 10 and at the same time prevent the face shield 7 from adhering to the face of the operator, the face shield 7 has a pair of folds 7*a* in an upper area thereof. Particularly, in operation these folds 7*a* lie over the sides of the above described visor 10.

Figure 4:
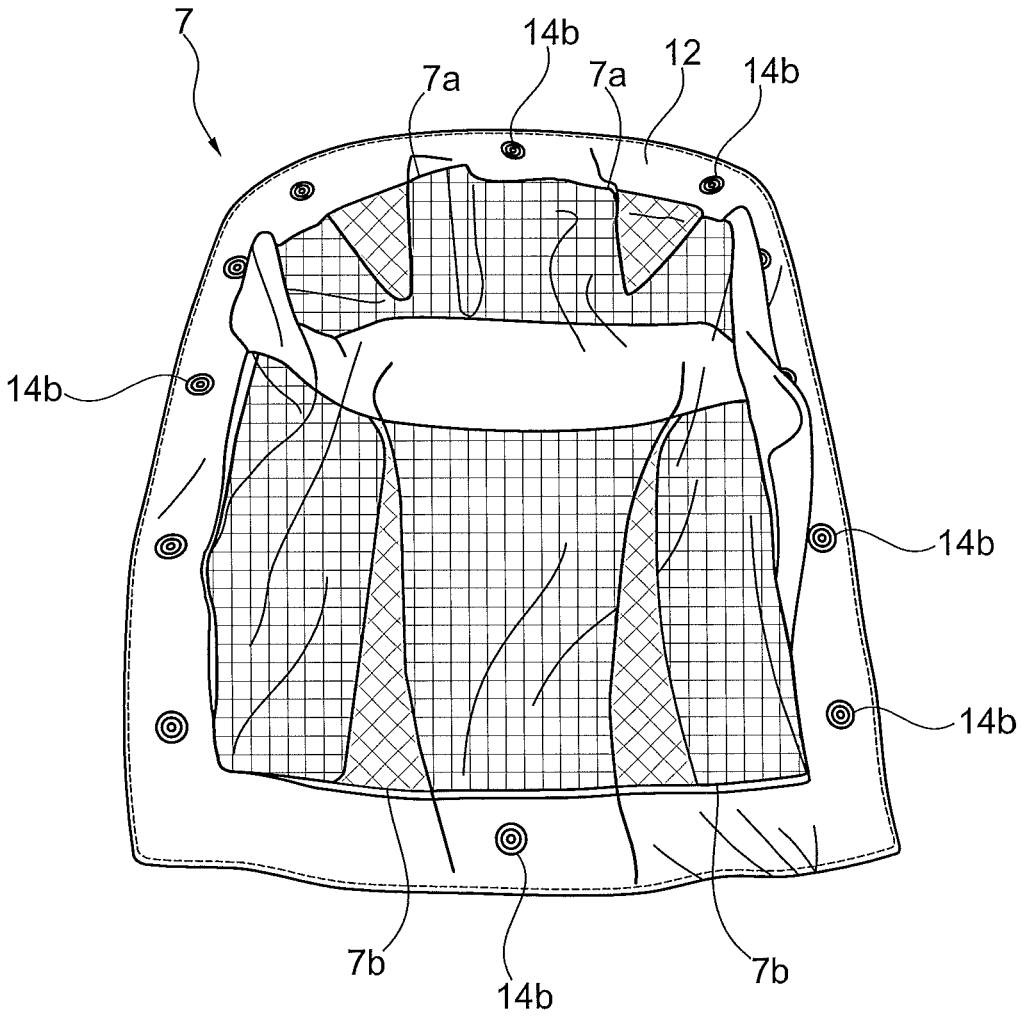
FIG. 4 is a rear view of a face shield of the headgear of FIG. 1.

Referring to FIG. 4, it shall be noted that additional folds 7*b* are situated on a lower area of the face shield 7. In operation, these additional folds 7*b* lie over the collar 16.

As mentioned above, the face shield 7 is formed from the fabric 9. Such fabric 9 has a density ranging from 25 to 40 g/m$^2$, such that the face shield so obtained is thin enough as to be substantially transparent and at the same time consistent enough as to ensure the required electric conductivity and hence the desired shielding effect. Preferably, the fabric 9 is tricot knitted. Alternative knitting arrangements may be obviously provided for the fabric 9, as long as they can ensure transparency and breathability as well as electrical conductivity and shielding effectiveness.

Figure 6:
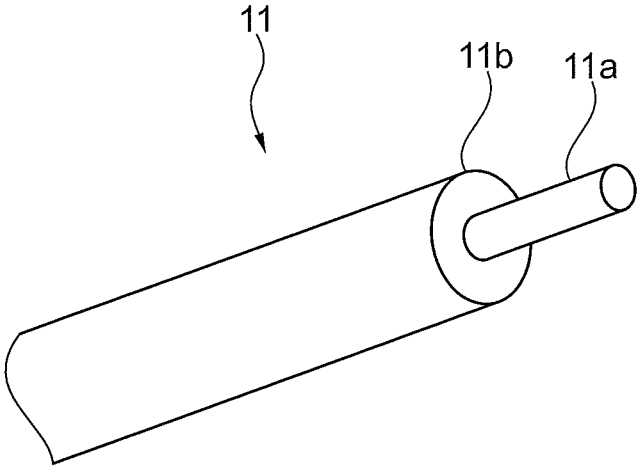
FIG. 6 is a perspective view of a yarn that is used to form a second part of the headgear of FIG. 1.

Particularly referring to FIG. 6, the fabric 9 comprises a plurality of yarns 11. The yarns 11 have a yarn count ranging from 10 to 30 deniers. Furthermore, each of the yarns 11 comprises a core 11*a*, preferably made of nylon. This core 11*a* is externally covered with a coating 11*b* made of a conductive material, preferably silver. For instance, the silver coating 11*b* may be sprayed on the core 11*a*. In a preferred embodiment, about 80% of the mass of the yarn 11 is made of silver.

As shown for instance in FIGS. 3 and 4, the headgear 1 comprises a border 12 for the face shield 7. Such border 12 is made of the aforementioned fabric 8.

According to a preferred embodiment, such border 12 is sewn to the face shield 7 using a yarn made of electrically conductive fire-proof fibers.

Furthermore, such border 12 has a width ranging from 2 to 4 cm, preferably of 3.5 cm. Preferably, the border 12 surrounds the entire perimeter of the face shield 7 and has a substantially constant width.

Advantageously, the face shield 7 is removably attached to the hood 2 using electrically conductive fastener means 13 which provide both mechanical coupling and electrical connection between the face shield 7 and the hood 2, the latter being in turn electrically connected to the shielding garment 17.

According to a preferred embodiment, the fastener means 13 comprise a plurality of snap fasteners 14, each comprising a first portion 14*a* with a protuberance and a second portion 14*b* with a cavity, that can be attached to the first portion 14*a*. More in detail, the first portions 14*a* are applied to the hood 2 at the perimeter 3*a* of the opening 3. The second portions 14*a* are sewn to the face shield 7 at the border 12.

In the preferred embodiment, the headgear 1 comprises twelve fasteners 14. One fastener 14 is applied to the upper portion of the hood 2, particularly behind and above the visor 10. Another fastener 4 is situated in the lower central part of the collar 16. Finally, five fasteners 14 are placed on each of the two lateral portions 2*b* of the hood 2, at the two sides of the opening 3.

Alternatively, the fastener means 13 may consist of a zipper or a hook and loop fastening system commercially available under the designation Velcro, provided that the face shield 7 will be electrically connected with the shielding garment 17, preferably but without limitation due to the electrical conductivity provided by the hood 2. For instance, if the hood is placed over a helmet made of an electrically insulating rigid material, the face shield 7, mechanically fastened thereto, will be electrically connected directly to the shielding garment 17 by means of dedicated electrical connection elements.

Whereas, particular embodiments of this invention have been described above for purposes of illustration, it will be evident to those skilled in the art that numerous variations of the details of the present invention may be made without departing from the invention as defined in the appended claims.

What is claimed is:

1. Headgear for a shielding garment for operating on components exposed to high voltage, or for operating at a safe distance proximate to high voltage parts, or for activities involving exposure to high electric and/or electromagnetic fields at frequencies and voltages, the headgear comprising:

a cover element structured and arranged to cover a head of an operator comprising an opening adapted to be positioned at least at an upper portion of the operator's face, and a transparent face shield made of an electrically conductive fabric, the face shield being removably coupled to said cover element to close the opening and being electrically connected to a shielding garment, the fabric having a density ranging from 25 to 40 g/m2, wherein the fabric comprises a plurality of yarns having a yarn count ranging from 10 to 30 deniers, and each of the plurality of yarns comprises a core externally covered with a coating made of a conductive metal.

2. The headgear of claim 1, wherein the fabric of the face shield is tricot knitted.

3. The headgear of claim 1, wherein the cover element is made of an electrically insulating rigid material, said face shield being removably fixed to said cover element and being electrically connected to said shielding garment.

4. The headgear of claim 1, wherein the cover element comprises a hood made of an electrically conductive fabric, the fabric of the hood comprising a plurality of yarns obtained by twisting aramid fibers with metallized fibers, said hood being electrically connected to said shielding garment, said face shield being removably fixed to said hood and being electrically connected to said hood and/or to said shielding garment.

5. The headgear of claim 4, wherein the face shield comprises a border made of said fabric of the hood.

6. The headgear of claim 5, wherein the border is sewn to said face shield.

7. The headgear of claim 6, wherein said border is sewn to said face shield with a yarn made of electrically conductive fire-proof fibers.

8. The headgear of claim 5, wherein the border has a width ranging from 2 to 4 cm.

9. The headgear of claim 8, wherein said width of said border is 3.5 cm.

10. The headgear of claim 4, wherein the headgear comprises electrically conductive fastener means for removably fixing said face shield to said hood.

11. The headgear of claim 10, wherein the fastener means comprise a plurality of snap fasteners, each comprising a first portion with a protuberance and a second portion with a cavity, said second portion being adapted to be attached to said first portion, said first portions being sewn on said hood at one perimeter of said opening, said second portions being sewn on said face shield.

12. The headgear of claim 11, wherein said second portions are sewn on said face shield at said border.

13. The headgear of claim 4, wherein the yarn of the fabric of the hood is 35% metallized fiber and 65% aramid fiber.

14. A shielding garment for operating on components exposed to high voltage, or when operating at a safe distance proximate to high voltage parts, or for activities involving exposure to high electric and/or electromagnetic fields at frequencies and voltages, comprising headgear as recited in claim 1.

* * * * *